US006455490B1

(12) United States Patent
Berthod et al.

(10) Patent No.: US 6,455,490 B1
(45) **Date of Patent: *Sep. 24, 2002**

(54) GRANULAR DETERGENT COMPONENT CONTAINING ZEOLITE MAP AND LAUNDRY DETERGENT COMPOSITIONS

(75) Inventors: Daniel Pierre Marie Berthod; Christophe Michel Bruno Joyeux; Johannes Hendrikus Langeveld, all of Vlaardingen (NL)

(73) Assignee: Unilever Home & Personal Care USA Division of Conopco, In.c, Greenwich, CT (US)

( * ) Notice: Subject to any disclaimer, the term of this patent is extended or adjusted under 35 U.S.C. 154(b) by 158 days.

This patent is subject to a terminal disclaimer.

(21) Appl. No.: 09/590,313

(22) Filed: Jun. 8, 2000

(30) Foreign Application Priority Data

Jun. 10, 1999 (GB) ..... 9913546

(51) Int. Cl.[7] ..... C10D 3/08; C10D 17/06

(52) U.S. Cl. ..... 510/507; 510/349; 510/441; 510/444; 510/446; 510/451; 510/466; 510/508; 510/511; 510/532

(58) Field of Search ..... 510/349, 441, 510/444, 446, 451, 466, 507, 508, 511, 532

(56) References Cited

U.S. PATENT DOCUMENTS

| | | | | |
|---|---|---|---|---|
| 4,265,777 | A | 5/1981 | Boyer et al. | 252/113 |
| 4,846,409 | A | 7/1989 | Kaspar et al. | 241/21 |
| 5,159,329 | A | 10/1992 | Lindmayer et al. | 340/825 |
| 5,519,948 | A | 5/1996 | Rasehse et al. | 34/347 |
| 5,583,098 | A | 12/1996 | Boskamp et al. | 510/351 |
| 5,665,671 | A | 9/1997 | Zanin | 504/117 |
| 5,665,691 | A | 9/1997 | France et al. | 510/444 |
| 5,739,097 | A | 4/1998 | Bauer et al. | 510/446 |
| 5,929,021 | A | 7/1999 | Dhanuka et al. | 510/444 |
| 6,056,905 | A | 5/2000 | Akkermans et al. | 264/117 |
| 6,063,751 | A | 5/2000 | France et al. | 510/444 |

FOREIGN PATENT DOCUMENTS

| | | |
|---|---|---|
| EP | 0 264 049 | 4/1988 |
| EP | 0 384 070 | 8/1990 |
| EP | 384 070 | 8/1990 |
| EP | 0 385 070 | 9/1990 |
| EP | 0 502 675 | 9/1992 |
| EP | 0 521 635 | 1/1993 |
| EP | 0 521 726 | 1/1993 |
| EP | 0 522 726 | 1/1993 |
| EP | 0 544 492 | 6/1993 |
| EP | 739 977 | 10/1996 |
| EP | 0 759 463 | 2/1997 |
| EP | 759463 A2 * | 2/1997 |
| EP | 799 884 | 10/1997 |
| GB | 1237084 | 6/1971 |
| GB | 1341557 | 12/1973 |
| GB | 2209172 | 5/1989 |
| WO | 93/15813 | 8/1993 |
| WO | 94/13773 | 6/1994 |
| WO | 95/25158 | 9/1995 |
| WO | 96/34084 | 10/1996 |
| WO | 97/22685 | 6/1997 |
| WO | 97/28246 | 8/1997 |
| WO | 98/11198 | 3/1998 |
| WO | 98/14551 | 4/1998 |
| WO | 98/14552 | 4/1998 |
| WO | 98/14553 | 4/1998 |
| WO | 98/14556 | 4/1998 |
| WO | 98/14557 | 4/1998 |
| WO | 98/14558 | 4/1998 |
| WO | 98/54286 | 12/1998 |
| WO | 98/54287 | 12/1998 |
| WO | 98/54288 | 12/1998 |
| WO | 98/58046 | 12/1998 |
| WO | 98/58047 | 12/1998 |
| WO | 98/58048 | 12/1998 |
| WO | 99/00475 | 1/1999 |
| WO | 99/03964 | 1/1999 |
| WO | 99/03966 | 1/1999 |
| WO | 99/03967 | 1/1999 |

OTHER PUBLICATIONS

PCT International Search Report in a PCT application PCT/GB 00/02030. Sep. 20, 2000.

PCT International Search Report in a PCT application PCT/GB 00/02056 Sep. 21, 2000.

GB Search Report in a patent application GB 9913546.9. Oct. 1, 1999.

PCT International Search Report in a PCT/GB application 00/02044. Sep. 28, 2000.

PCT International Search Report in a PCT/GB application 00/02042. Sep. 27, 2000.

Derwent Abstract of WO 93/15813—published Aug. 19, 1993.

Co–pending application: Applicant: Bakker et al., Serial No. 09/590,162, Filed Jun. 8, 2000.

* cited by examiner

*Primary Examiner*—Yogendra N. Gupta
*Assistant Examiner*—Brian P. Mruk
(74) *Attorney, Agent, or Firm*—Rimma Mitelman

(57) ABSTRACT

A non-spray-dried granular component suitable for use in a particulate zero-phosphate laundry detergent composition comprises from 10 to 30 wt % of organic surfactant and from 20 to 50 wt % of zeolite MAP, the component having a bulk density not exceeding 700 g/l. The component may be prepared by a mixing and agglomeration process using a high-speed mixer, a moderate- or low-speed mixer, and a gas fluidization granulator. The component may be used in conjunction with a spray-dried granular component of lower bulk density, for example, a spray-dried detergent base powder containing organic surfactant and zeolite A, or a spray-dried sodium-carbonate-based adjunct.

19 Claims, No Drawings

GRANULAR DETERGENT COMPONENT CONTAINING ZEOLITE MAP AND LAUNDRY DETERGENT COMPOSITIONS

TECHNICAL FIELD

The present invention relates to a granular detergent component containing zeolite MAP builder, and to particulate laundry detergent compositions containing it. More particularly the invention relates to zeolite-built compositions having bulk densities within the range of from 600 to 900 g/l.

BACKGROUND

Particulate laundry detergent compositions of reduced or zero phosphate content containing zeolite builder are now well known and widely available. The original detergent zeolite was zeolite A, available in slurry, granule and powder forms, which has been used in low- and zero-phosphate laundry powders for many years. More recently, zeolite MAP (maximum aluminium zeolite P), as described and claimed in EP 384 070B (Unilever), has also become available.

Detergent powders normally consist of a principal homogeneous granular component, normally referred to as the base powder, containing at least organic-surfactant and inorganic builder, and generally containing other robust ingredients. Traditionally the base powder has been prepared by spray-drying a slurry at elevated temperature to give porous crisp granules of low bulk density, for example 300 to 400 g/l. Heat sensitive and/or less robust ingredients such as bleaches, enzymes, antifoams and certain nonionic surfactants are then admixed (postdosed) to the base powder. Postdosing generally causes an increase in bulk density but values higher than about 550 g/l are rare.

In recent years "compact" or "concentrated" powders having a higher bulk density than is attainable by spray-drying and postdosing alone have become popular. In such powders, the base powder may be prepared by densifying a spray-dried powder, or by wholly non-tower processing (mechanical mixing). Concentrated base powders typically have a bulk density of at least 700 g/l. Postdosing of additional ingredients, as in traditional powders, can bring the bulk density up to 800 g/l or above.

Concentrated (non-tower) powders have various advantages, for example: their production consumes less energy and produces less pollution than does spray-drying; there is more freedom to incorporate a wide range of ingredients because heat sensitivity is less critical; the powders can be produced to a lower moisture content, so stability of moisture-sensitive ingredients such as sodium percarbonate is better. Spray-dried powders, on the other hand, tend to have better powder properties; they may be dosed into drum-type front-loading washing machines via the dispenser drawer, whereas non-tower powders generally require a dispensing device, and they disperse and dissolve in the wash liquor more quickly and completely. They also attract considerable consumer loyalty, for example, because the dosage amount and method are familiar.

Accordingly, while concentrated powders have become popular and offer many advantages, spray-dried powders have retained a considerable consumer following. There is therefore a need for powders which combine the advantages of both types of powders without the disadvantages. The manufacturer will also wish to be able to offer a selection of products ranging from conventional to concentrated. From the manufacturer's point of view, it is operationally advantageous if this can be done using a single common base powder, or at least as small a number of base powder variants as possible.

As described and claimed in EP 521 726A and EP 544 492B (Unilever), zeolite MAP has a better carrying capacity for mobile organic ingredients such as hydrophobic ethoxylated nonionic surfactants, which makes it significantly more suitable than zeolite A for formulating concentrated high-performance non-tower base powders, allowing higher surfactant loadings without loss of powder properties such as flow. Another advantage of zeolite MAP, as described and claimed in EP 522 726B (Unilever), is that, unlike zeolite A, it does not destabilise sodium percarbonate bleach, and allows the formulation of concentrated powders containing percarbonate. Zeolite MAP, therefore, is ideally suited for use in non-tower base powders of high quality.

However, zeolite MAP is not ideal for preparing spray-dried powders, tending to give dusty powders containing high levels of fine particles. It is also available only as a dried powder, so its use in a slurry-based process is uneconomic and wasteful of energy. The use of zeolite MAP to prepare powders of lower bulk density via the spray-drying route is therefore not preferred.

The present inventors have now discovered that a non-tower zeolite MAP base powder of lower bulk density may be produced, which may be used to formulate detergent powders of lower final bulk density. If desired, the bulk density may be lowered further by also including in the formulations a lesser amount of a spray-dried component. The resulting products have good powder properties and the stability of sodium percarbonate is not compromised.

PRIOR ART

Zeolite MAP as a new detergency builder is disclosed in EP 385 070B (Unilever). The high liquid carrying capacity of zeolite MAP and its use in the preparation of high performance laundry detergent powders are disclosed in EP 521 635A and EP 544 492A (Unilever). The beneficial effect of zeolite MAP on sodium percarbonate stability is disclosed in EP 522 726B (Unilever).

WO 98 54288A (Unilever) discloses a particulate laundry detergent composition having a bulk density of at least 550 g/l, comprising a non-tower base powder and a spray-dried adjunct, wherein the non-tower base powder constitutes from 35 to 85 wt % of the total composition. The non-tower base powder may contain zeolite MAP. The spray-dried adjunct preferably comprises crystal-growth-modified sodium sesquicarbonate.

WO 96 34084A (Procter & Gamble/Dinniwell) discloses a low-dosage, highly dense detergent powder comprising about 40 to 80% by weight of spray-dried detergent granules, about 20 to 60% by weight of dense detergent agglomerates, and about 1 to 20% by weight of postdosed ingredients. Preferably the weight ratio of spray-dried granules to agglomerates is 1:1 to 3:1.

DEFINITION OF THE INVENTION

The present invention provides a non-spray-dried granular component suitable for use in a particulate zero-phosphate laundry detergent composition, the component comprising from 10 to 30 wt % of organic surfactant and from 20 to 50 wt % of zeolite, wherein the zeolite consists wholly of zeolite MAP and the component has a bulk density not exceeding 700 g/l.

The present invention further provides a particulate zero-phosphate laundry detergent composition having a bulk density within the range of from 550 to 950 g/liter, which comprises a granular detergent component as defined in the previous paragraph, in admixture with one or more other detergent ingredients.

DETAILED DESCRIPTION OF THE INVENTION

The Granular Zeolite-MAP-based Detergent Component

The first aspect of the present invention is a non-spray-dried zeolite-MAP-based granular detergent component having a lower bulk density than previously prepared zeolite-MAP-based non-spray-dried detergent components.

Zeolite MAP has been described in EP 384 070B (Unilever). It is zeolite P having a silicon to aluminium ratio (molar) not exceeding 1.33:1, preferably not exceeding 1.06:1, and most preferably about 1:1.

The granular detergent component has a bulk density not exceeding 700 g/l, preferably within the range of from 600 to 700 g/l and more preferably within the range of from 600 to 650 g/l.

The granular component comprises from 10 to 30 wt % of organic surfactant and from 20 to 50 wt % of zeolite, wherein the zeolite consists wholly of zeolite MAP. Preferably it contains from 30 to 50 wt % of zeolite MAP.

The granular component may suitably further comprise:

from 10 to 45 wt % of sodium carbonate plus optional sodium sulphate, optionally from 0 to 10 wt % of layered sodium silicate, and optionally minor ingredients to 100 wt %.

Typically the granular component may comprise:

from 10 to 25 wt % of anionic sulphonate or sulphate surfactant, from 5 to 20 wt % of ethoxylated nonionic surfactant, from 30 to 45 wt % of zeolite MAP, optionally from 0 to 10 wt % of layered sodium silicate, from 15 to 30 wt % of sodium carbonate plus optional sodium sulphate, and optionally minor ingredients to 100 wt %.

The granular detergent component may further comprise minor ingredients selected from fatty acid, fatty acid soap, polycarboxylate polymer, sodium citrate, fluorescers and antiredeposition agents.

The granular component is a non-tower zeolite-MAP-based detergent base powder. It provides all the advantages associated with zeolite MAP, for example, the high liquid carrying capacity and the ability to formulate to a low moisture content, but at a lower bulk density than has previously been attainable by non-tower processing.

Preparation of the Granular Component

Preparation of the granular component to a bulk density not exceeding 700 g/l and preferably not exceeding 650 g/l has been made possible by a process which comprises the following steps:

(i) mixing and agglomerating a liquid binder with a solid starting material in a high-speed mixer;

(ii) mixing the material from step (i) in a moderate- or low-speed mixer;

(iii) feeding the material from step (ii) and a liquid binder into a gas fluidisation granulator and further agglomerating, and (iv) optionally, drying and/or cooling.

This process is described in more detail, and claimed, in our copending British patent application of even date (Case C3932).

Suitable high-speed mixers are any one of a variety of commercially available mixers such as, for example, those available from Lödige, Schugi and Drais. Particularly preferred machines include the Lödige (Trade mark) CB Recycler machine and the Drais (Trade Mark) K-TTP.

A suitable example of a moderate- or slow-speed mixer is a Lödige (Trade Mark) KM mixer, also referred to as Lödige Ploughshare. This apparatus has mounted on its shaft various plough-shaped tools. Optionally, one or more high-speed cutters can be used to prevent the formation of oversize or lumpy material. Another suitable machine for this step is, for example the Drais (Trade Mark) K-T.

The process in the mixers can be carried out batchwise or continuously, but is preferably continuous.

The third step of the process of the invention utilises a gas fluidisation granulator. In this kind of apparatus, a gas (usually air) is blown through a body of particulate solids into or onto which is sprayed a liquid component. A gas fluidisation granulator is sometimes called a "fluidised bed" granulator or mixer. This is not strictly accurate since such mixers can be operated with a gas flow rate so high that a classical "bubbling" fluid bed does not form.

The gas fluidisation granulation and agglomeration process step is preferably carried out substantially as described in WO 98 58046A and WO 98 58047A (Unilever).

In a final step, the granules can be dried and/or cooled if necessary. This step can be carried out in any known manner, for instance in a fluid bed apparatus (drying and cooling) or in an airlift (cooling). Drying and/or cooling can be carried out in the same fluid bed apparatus as used for the final agglomeration step simply by changing the process conditions employed as will be well-known to the person skilled in the art. For example, fluidisation can be continued for a period after addition of liquid binder has been completed and the air inlet temperature can be reduced.

The entire process is preferably carried out continuously.

Detergent Compositions

A second aspect of the present invention is a particulate zero-phosphate laundry detergent composition incorporating the zeolite-MAP-based granular component of the invention.

As previously described, laundry detergent compositions have traditionally contained as a principal component a "base powder", either spray-dried or non-tower, consisting of structured particles containing surfactant and builder. Other ingredients unsuitable for processing into the base powder are subsequently admixed or "postdosed".

The detergent compositions of the invention may contain the zeolite-MAP-based granule of the present invention as the sole base powder. Accordingly, a detergent composition of the invention might consist of the zeolite-MAP-based granular component, as base powder, plus postdosed ingredients as required.

Alternatively, if a final product of lower bulk density is desired, the compositions may contain a second granular component, which is spray-dried.

Accordingly, a further aspect of the present invention is a particulate zero-phosphate laundry detergent composition containing at least two different granular components containing organic surfactant and zeolite builder, comprising:

(i) a first granular component which is a non-spray-dried zeolite-MAP-based granular component according to the present invention, as defined previously, (ii) a second granular component which is spray-dried and has a bulk density of less than 500 g/l.

The second granular component preferably has a bulk density from 200 to 450 g/l.

The first and second granular components are preferably present in a weight ratio of at least 1:1, more preferably within the range of from 1.5:1 to 10:1.

The detergent composition of the invention may suitably comprise:

(i) from 30 to 70 wt %, preferably from 35 to 55 wt %, of the first granular component, (ii) from 5 to 40 wt %, preferably from 7 to 25 wt %, of the second granular component, (iii) optionally other admixed detergent ingredients to 100 wt %.

Two preferred embodiments of the invention are envisaged. According to the first preferred embodiment of the invention, the second granular component is a second base powder containing zeolite, but differing from the first granular component in that it is spray-dried and contains zeolite A rather than zeolite MAP. According to the second preferred embodiment of the invention, the spray-dried granular component is a mostly inorganic component based on sodium carbonate. These two embodiments are discussed in more detail below.

The other admixed (postdosed) ingredients may, for example, be selected from surfactant granules, bleach ingredients, antifoams, fluorescers, antiredeposition agents, soil release agents, dye transfer inhibiting agents, fabric conditioning agents, enzymes, perfumes, inorganic salts and combinations thereof.

The admixed detergent ingredients may include sodium percarbonate. Surprisingly, in the first preferred embodiment of the invention, the storage stability of sodium percarbonate does not appear to be compromised by the presence of the zeolite A base powder.

It is preferred that the major proportion of organic surfactants to be included in the final composition should be incorporated in the first granular component. The high liquid carrying capacity of the zeolite MAP allows high loadings of mobile organic surfactants without detriment to powder properties. Any surfactants which are sensitive to heat and/or moisture, for example, nonionic surfactants, primary alcohol sulphates, glucamide, should be incorporated in the first granular component.

In general, any ingredients suitable for base powder incorporation (as opposed to postdosing) which are sensitive to heat or to moisture or to both should be included in the first granular component.

Any supplementary inorganic builders of high liquid carrying capacity should be incorporated in the first granular component. An example of a supplementary inorganic builder having a high liquid carrying capacity is layered sodium silicate, for example, SKS-6 ex Clariant. Any supplementary builders that do not exhibit high liquid carrying capacity are more preferably incorporated in the second granular component.

Inorganic salts such as sodium carbonate or sodium sulphate may be incorporated in the first granular component. Salts of small particle size, for example light soda ash, should be incorporated by granulation in the first granular component, so that a final product having a low content of "fines" is achieved. Sodium sulphate may be incorporated in the first granular component if desired.

The products of the invention have excellent powder properties. Flow properties are good and the proportion of fine particles below 180 micrometres is low: typically below 15 wt %. Dispensing into a front-loading automatic washing machine is excellent, giving negligible residues.

It is also believed that the presence of the highly soluble and quickly dissolving spray-dried component (second granular component) may aid dispersion and dissolution in the wash.

Without wishing to be bound by theory, it is believed that sequential dissolution of the spray-dried component (the second granular component) and the non-tower base (the first granular component) may occur. It is therefore advantageous if a soluble builder such as sodium citrate or acrylic/maleic polymer is present in the spray-dried second granular component, for rapid release into the wash liquor before the bulk of the surfactants are delivered from the non-tower base.

The Second Granular (Spray-dried) Component

As previously indicated, according to the first preferred embodiment of the invention, the second granular component is a spray-dried base powder containing zeolite A. According to the second preferred embodiment of the invention, the spray-dried granular component is a mostly inorganic component based on sodium carbonate.

The Spray-dried Zeolite-A-based Base Powder

In the first preferred embodiment of the invention, the second granular component is a spray-dried zeolite A base powder and has a bulk density below 500 g/l, preferably from 200 to 450 g/l, typically from 275 to 425 g/l. It may suitably comprise:

from 10 to 30 wt % of organic surfactant, from 20 to 50 wt % of zeolite A, from 10 to 45 wt % of other salts and polymer, and optionally minor ingredients to 100 wt %, all percentages being based on the second granular component.

The dissolution rate of the second granular component will be higher than that of the first granular component (the non-tower zeolite-MAP-based granule). It is advantageous for any soluble cobuilders to be incorporated in the second granular component, and for only a minority of the total surfactant of the formulation to be incorporated in the second granular component. In the wash liquor, the spray-dried second granular component will dissolve rapidly to lower the calcium ion concentration before the major part of the surfactant present is released from the more slowly dissolving first granular component.

The second granular component preferably comprises sodium citrate, in an amount of from 1 to 10 wt %, preferably from 2 to 5 wt %.

Alternatively or additionally, the second granular component may comprises a polycarboxylate polymer, preferably an acrylic polymer and more preferably an acrylic/maleic copolymer such as Sokalan (Trade Mark) CP5 ex BASF, in an amount of from 1 to 10 wt %, preferably from 3 to 8 wt %.

The second granular component may further comprise sodium silicate, generally incorporated in solution form. The sodium silicate may, for example, be present in an amount of from 0.5 to 10 wt %, preferably from 1 to 5 wt %.

More preferably, the second granular component comprises:

from 10 to 25 wt % of anionic sulphonate or sulphate surfactant, from 1 to 10 wt % of ethoxylated nonionic surfactant, from 25 to 45 wt % of zeolite A, from 1 to 10 wt % of sodium citrate, from 1 to 10 wt % of acrylic or acrylic/maleic polymer, from 0.5 to 10 wt % of sodium silicate, from 15 to 40 wt % of other salts, and optionally minor ingredients to 100 wt %.

The other salts may include sodium sulphate, which may be incorporated in the first or second granular component, or in both, and/or may be postdosed. In formulations in which the amount of sodium sulphate is not to exceed a certain level, any sodium sulphate present is preferably incorporated in the second granular component.

The second granular component may contain optional minor ingredients suitable for incorporation into a spray-dried base powder. These may, for example, be selected from fatty acid, fatty acid soap, fluorescers and antiredeposition agents.

When the second granular component is a zeolite-A-based based powder, the first and second granular components are preferably present in a weight ratio within the range of from 1.5:1 to 5:1.

In this embodiment of the invention, the weight ratio of zeolite MAP to zeolite A in the final product is preferably at least 1:1.

The Spray-dried Carbonate-based Adjunct

In the second preferred embodiment of the invention, the second granular component is a spray-dried adjunct containing at least 45 wt % of inorganic material, preferably based on sodium carbonate. The bulk density of the adjunct is preferably from 200 to 450 g/l, typically from 200 to 300 g/l.

The spray dried adjunct may comprises from 0 to 20% by weight of organic surfactant based on the total weight of the adjunct. Suitable surfactant materials are described below under "Detergent Ingredients". However, the adjunct is preferably free or substantially free of organic surfactant.

The adjunct may comprise from 45 to 95% by weight, preferably from 50 to 90%, of inorganic material based on the total weight of the adjunct. The inorganic material preferably consists wholly or predominantly of sodium carbonate, or sodium carbonate in admixture with sodium sulphate.

Preferably, the inorganic material comprises a carbonate salt which is sodium carbonate monohydrate, or especially, sodium sesquicarbonate or Burkeite (sodium carbonate/sodium sulphate double salt). Especially preferred are crystal-growth-modified carbonate salts as described in EP 221 776A (Unilever), in particular, crystal-growth-modified sodium sesquicarbonate, sodium carbonate monohydrate, or Burkeite.

Sodium sesquicarbonate is preferably formed in situ from the aqueous reaction of sodium carbonate with acid. organic acids such as citric acid and maleic/acrylic polymer in acid form (Sokalan (Trade Mark) CP45 from BASF), detergent sulphonic acids eg linear alkylbenzene sulphonic acid (LAS acid) or other conventional organic acids may be used to produce the sesquicarbonate. Alternatively, suitable inorganic acids may be used. Burkeite is preferably formed in situ from the aqueous reaction of sodium carbonate with sodium sulphate.

The adjunct preferably further comprises a fatty acid, preferably a $C_{10}$–$C_{22}$ fatty acid. The fatty acid may be converted to the corresponding soap during the preparation of the adjunct. Typically the level of fatty acid/soap in the adjunct is up to 10% by weight, preferably from 0.5% to 6%, based on the total weight of the adjunct.

The spray-dried adjunct may further comprise up to 25% by weight, preferably 5 to 20% by weight, based on the total weight of the adjunct, of a polymer. Any polymers conventionally present in detergent products may be included. Preferred polymers include amongst others, polyvinyl pyrrolidone (PVP) and vinyl pyrrolidone copolymers, cellulosic polymers such as sodium carboxymethyl cellulose, and acrylic polymers such as Sokalan (Trade Mark) CP5 (a sodium salt of maleic/acrylic acid copolymer, available from BASF). The CP5 polymer may be produced from the corresponding acid (CP45) during the conversion of an inorganic material precursor (eg sodium carbonate) to an inorganic material (eg sodium sesquicarbonate).

A citrate may also be present in the spray-dried adjunct, in particular where sodium sesquicarbonate has been produced in situ by the action of an acid upon sodium carbonate. The spray-dried adjunct may comprise up to 25 wt % of citrate, preferably up to 20 wt % based on the total weight of the adjunct. Preferably the citrate is sodium citrate.

The spray-dried adjunct may also contain a silicate, preferably sodium silicate, in an amount of up to 25 wt % based on the total weight of the adjunct.

Usually the adjunct comprises from 0.5 to 30 wt % of free water, preferably from 1 to 25 wt % and most preferably from 5 to 20 wt % based on the total weight of the adjunct.

The spray-dried adjunct may optionally further comprise small amounts of other components suitable for inclusion in a granular material via a spray-drying process. The spray-dried adjunct may be treated so that other minor ingredients, or low levels of organic surfactant, may be sprayed onto the adjunct.

As in the first preferred embodiment of the invention, the dissolution rate of the second granular component will be higher than that of the first granular component (the non-tower zeolite-MAP-based granule), the differential being even greater in this second embodiment. Again the incorporation of soluble builders such as citrate and polymer is advantageous, as indicated above.

In this embodiment of the invention, the weight ratio of the first granular component to the second granular component is preferably within the range of from 3:1 to 10:1.

Preparation of the Second Granular Component

The second granular component may be prepared by traditional slurry making and spray-drying methods, well known to the skilled detergent powder formulator. This applies whether the second granular component is a zeolite-A-based base powder, or a mostly inorganic sodium-carbonate-based adjunct.

For the spray-drying of sesquicarbonate-containing adjuncts it has been found that recirculation, supersaturation or agitation (or a combination thereof) of the slurry during spray-drying helps to achieve fast crystallisation and produce an adjunct of a suitable bulk density.

Typically the sesquicarbonate containing slurries comprise 40 to 60 wt % of total water in order to provide suitable properties for spray-drying.

Detergent Ingredients

As previously indicated, detergent compositions of the invention contain detergent-active compounds and detergency builders, and may optionally contain bleaching components and other active ingredients to enhance performance and properties.

Detergent-active compounds (surfactants) may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds. The total amount of surfactant present is suitably within the range of from 5 to 40 wt %.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are long or short hydrocarbyl chains, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

Detergent compositions suitable for use in most automatic fabric washing machines generally contain anionic non-soap surfactant, or nonionic surfactant, or combinations of the two in any ratio, optionally together with cationic, amphoteric or zwitterionic surfactants, optionally together with soap.

The detergent compositions of the invention also contain one or more detergency builders. The total amount of detergency builder in the compositions will suitably range from 5 to 80 wt %, preferably from 10 to 60 wt %.

The zeolite builders may suitably be present in a total amount of from 5 to 60 wt %, preferably from 10 to 50 wt %. Amounts of from 10 to 45 wt % are especially suitable for particulate (machine) laundry detergent compositions.

The zeolites may be supplemented by other inorganic builders, for example, amorphous aluminosilicates, or layered silicates such as SKS-6 ex Clariant. Sodium carbonate, already listed as a possible ingredient, may also act in part as a builder. Phosphate builders, however, are preferably absent.

The zeolites may be supplemented by organic builders, for example, polycarboxylate polymers such as polyacrylates and acrylic/maleic copolymers; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

These lists of builders are not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. Builders, both inorganic and organic, are preferably present in alkali metal salt, especially sodium salt, form.

Detergent compositions according to the invention may also suitably contain a bleach system. Preferably this will include a peroxy bleach compound, for example, an inorganic persalt or an organic peroxyacid, capable of yielding hydrogen peroxide in aqueous solution.

Preferred inorganic persalts are sodium perborate monohydrate and tetrahydrate, and sodium percarbonate, the latter being especially preferred. The sodium percarbonate may have a protective coating against destabilisation by moisture. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %. Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA), diethylenetriamine pentaacetate (DTPA), ethylenediamine disuccinate (EDDS), and the polyphosphonates such as the Dequests (Trade Mark), ethylenediamine tetramethylene phosphonate (EDTMP) and diethylenetriamine pentamethylene phosphate (DETPMP).

The compositions of the invention may contain alkali metal, preferably sodium, carbonate, in order to increase detergency and ease processing. Sodium carbonate may suitably be present in amounts ranging from 1 to 60 wt %, preferably from 2 to 40 wt %.

As previously indicated, sodium silicate may also be present. The amount of sodium silicate may suitably range from 0.1 to 5 wt %. Sodium silicate, as previously indicated, is preferably introduced via the second granular component.

Powder flow may be improved by the incorporation of a small amount of a powder structurant. Examples of powder structurants, some of which may play other roles in the formulation as previously indicated, include, for example, fatty acids (or fatty acid soaps), sugars, acrylate or acrylate/maleate polymers, sodium silicate, and dicarboxylic acids (for example, Sokalan (Trade Mark) DCS ex BASF). One preferred powder structurant is fatty acid soap, suitably present in an amount of from 1 to 5 wt %.

Other materials that may be present in detergent compositions of the invention include antiredeposition agents such as cellulosic polymers; soil release agents; anti-dye-transfer agents; fluorescers; inorganic salts such as sodium sulphate; enzymes (proteases, lipases, amylases, cellulases); dyes; coloured speckles; perfumes; and fabric conditioning compounds. This list is not intended to be exhaustive.

EXAMPLES

The invention is further illustrated by the following non-limiting Examples, in which parts and percentages are by weight unless otherwise stated.

Measurement of Dynamic Flow Rate (DFR)

The apparatus used consists of a cylindrical glass tube having an internal diameter of 35 mm and a length of 600 mm. The tube is securely clamped in a position such that its longitudinal axis is vertical. Its lower end is terminated by means of a smooth cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time t (seconds) taken for the powder level to fall from the upper sensor to the lower sensor is measured electronically. The measurement is normally repeated two or three times and an average value taken. If V is the volume (ml) of the tube between the upper and lower sensors, the dynamic flow rate DFR (ml/s) is given by the following equation:

$$DFR = \frac{V}{t} \text{ ml/s}$$

The averaging and calculation are carried out electronically and a direct read-out of the DFR value obtained.

Measurement of Dispenser Residues

For the purposes of the present invention, dispensing into an automatic washing machine is assessed by means of a standard procedure using a test rig based on the main wash compartment of the dispenser drawer of the Philips (Trade Mark) AWB 126/7 washing machine. This drawer design provides an especially stringent test of dispensing characteristics especially when used under conditions of low temperature, low water pressure and low rate of water flow.

The drawer is of generally cuboidal shape and consists of a main compartment, plus a small front compartment and a separate compartment for fabric conditioner which play no part in the test. In the test, a 100 g dose of powder is placed in a heap at the front end of the main compartment of the drawer, and subjected to a controlled water fill of 5 liters at 10° C. and an inlet pressure of 50 kPa, flowing in over a period of 1 minute. The water enters through 2 mm diameter holes in a plate above the drawer: some water enters the front compartment and therefore does not reach the powder. Powder and water in principle leave the drawer at the rear end which is open.

After 1 minute the flow of water is ceased, and the powder remaining is then collected and dried at 90° C. to constant weight. The dry weight of powder recovered from the dispenser drawer, in grams, represents the weight percentage of powder not dispensed into the machine (the residue). Every result is the average of two duplicate measurements.

Abbreviations

The following abbreviations are used for ingredients used in the Examples:

| | |
|---|---|
| LAS | Linear alkylbenzene sulphonate |
| Nonionic 7EO | $C_{12-15}$ alcohol ethoxylated with an average of 7 moles of ethylene oxide per mole |
| Ca EDTMP | Calcium salt of ethylenediamine tetramethylene phosphonate |
| TAED | Tetraacetyl ethylenediamine |
| SCMC | Sodium carboxymethylcellulose |
| AA/MA copolymer | Acrylic/maleic copolymer |
| Protease | Savinase 12.0 TXT granules |

Examples 1 to 4

Comparative Examples A and B

Base Powers

Granular detergent base powders of the formulations detailed in Table 1 were prepared, by (i) mixing and granulating solid starting materials consisting of zeolite MAP, light soda ash, sodium carboxymethylcellulose (SCMC) and sodium citrate with "liquid binder" (LAS acid, nonionic surfactant, fatty acid/soap—see below) in a Lödige Recycler (CB 30) high-speed mixer;

(ii) transferring the material from the Recycler to a Lödige Ploughshare (KM 300) moderate-speed mixer;

(iii) transferring the material from the Ploughshare to a Vometec (Trade mark) fluid bed operating as a gas fluidisation granulator, adding further "liquid binder" and agglomerating; and (iv) finally drying/cooling the product in the fluid bed.

The conditions in steps (i) to (iii) were as follows:

(i) Lödige Recycler (CB 30)
Residence time: about 15 seconds
Shaft rotation speed: 1000 rpm
Tip speed: 15.7 m/s
Froude number: 168

(ii) Lödige Ploughshare (KM 300)
Residence time about: 3 minutes
Shaft rotation speed: 100 rpm
Choppers: Switched off
Tip speed: 2.62 m/s
Froude number: 2.8
Liquid binder: None added (iii)Fluid bed (batch Vomotec apparatus, batch size 10 kg):
Superficial air velocity 1.0 m/s
Fluidisation gas temperature: 75° C.
Atomisation gas temperature: Hot
Atomisation air pressure: 3.5 bar
Height of nozzle (above distributor plate): 47 cm
Rate of spray-on of binder: 800 g/min The "liquid binder" used in steps (i) and (iii) was a structured blend comprising the anionic surfactant, nonionic surfactant and soap components of the base powder. The blend was prepared by mixing 38.44 parts by weight of LAS acid precursor and 5.20 parts by weight fatty acid in the presence of 41.60 parts by weight of ethoxylated nonionic surfactant in a blend-loop and neutralising with 14.75 parts of a sodium hydroxide solution. The blend temperature in the loop was controlled by a heat-exchanger. The neutralising agent was a sodium hydroxide solution. The resulting blend had the following composition:

| | |
|---|---|
| Na-LAS | 39.9 |
| Nonionic surfactant (7EO) | 41.6 |
| Soap | 5.6 |
| Water | 12.9 |

The proportions of the liquid binder added in the recycler and in the gas fluidisation granulator were varied as detailed in Table 1.

The bulk density and DFR values for both the fresh and weathered product are given in Table 1, as are the levels of fine and coarse material in the product.

The results in Table 1 clearly demonstrate a general decrease in bulk density of the product as the ratio of binder added in step (i) to that added in step (ii) decreases. Examples 1 to 4 according to the invention had bulk densities, after weathering, below 700 g/l.

TABLE 1

| | A | B | 1 | 2 | 3 | 4 |
|---|---|---|---|---|---|---|
| BASE POWDER | | | | | | |
| Na-LAS | 11.35 | 11.66 | 12.08 | 12.23 | 12.77 | 13.30 |
| Nonionic 7EO | 11.72 | 12.04 | 12.47 | 12.63 | 13.19 | 13.73 |
| Soap | 1.58 | 1.62 | 1.68 | 1.70 | 1.78 | 1.85 |
| Zeolite A24 | 37.47 | 37.07 | 36.53 | 36.32 | 35.63 | 34.95 |
| Light soda ash | 25.90 | 25.63 | 25.25 | 25.12 | 24.64 | 24.17 |
| SCMC | 0.84 | 0.83 | 0.82 | 0.81 | 0.80 | 0.78 |
| Citrate | 3.45 | 3.41 | 3.36 | 3.35 | 3.28 | 3.22 |
| Moisture, salts | 7.69 | 7.74 | 7.81 | 7.84 | 7.91 | 8.00 |
| Total | 100.00 | 100.00 | 100.00 | 100.00 | 100.00 | 100.00 |

TABLE 1-continued

| | A | B | 1 | 2 | 3 | 4 |
|---|---|---|---|---|---|---|
| PROCESSING CONDITIONS | | | | | | |
| Binder in recycler (wt %) | 80 | 78 | 74 | 68 | 55 | 40 |
| Binder in fluid bed (%) | 20 | 22 | 26 | 32 | 45 | 60 |
| FRESH PROPERTIES | | | | | | |
| BD (g/l) | 740 | 703 | 712 | 639 | 612 | 571 |
| DFR (ml/s) | 108 | 115 | 122 | 123 | 125 | 115 |
| WEATHERED PROPERTIES | | | | | | |
| BD (g/l) | 739 | 719 | 658 | 655 | 615 | 579 |
| DFR (ml/s) | 115 | 110 | 122 | 130 | 120 | 112 |
| Av. particle size | 626 | 546 | 496 | 519 | 524 | 557 |
| Fines (<180) (%) | 8.3 | 8.6 | 9.1 | 6.7 | 4.2 | 4.2 |
| Coarse (>1400) (%) | 2.6 | 1.5 | 1 | 0.9 | 1 | 1.8 |

Examples 5 and 6

Comparative Examples C and D

Particulate Detergent Compositions

Three base powders and one adjunct were prepared as follows:

Non-tower base powder B1 was prepared by a process as described in Examples 1 to 4.

Non-tower base powder B2, of higher bulk density than B1, was prepared by non-tower granulation as described, for example, in EP 340 013A, EP 367 339A, EP 390 251A and EP 420 317A (Unilever): solid and liquid ingredients were granulated continuously in a high-speed mixer (Lödige CB30 Recycler).

Spray-dried base powder S1 was prepared by a conventional slurry-making and spray-drying process.

Spray-dried sesquicarbonate adjunct E1 was prepared as follows. Acrylic/maleic copolymer in acid form (Sokalan CP45) and citric acid were premixed, fatty acid was added, and the premix maintained at approximately 70° C. Sodium carbonate (light ash), and subsequently water, were then added to produced a slurry having a total moisture content of approximately 50%, which was maintained below 80° C. prior to spray-drying. The slurry was spray-dried at an outlet temperature of about 100° C. to produce an adjunct containing crystal-growth-modified sodium sesquicarbonate.

The formulations and powder properties of the base powders and adjuncts were as shown in Table 2 below.

TABLE 2

| | B2 | B1 | S1 | E1 |
|---|---|---|---|---|
| LAS (as acid) | 11.70 | 11.84 | | |
| LAS | | | 12.18 | |
| Nonionic 7EO | 14.50 | 12.81 | 3.52 | |
| Soap/fatty acid | 1.90 | 1.73 | 4.00 | 1.50 |
| Zeolite A (100%) | | | 32.00 | |
| Zeolite MAP (100%) | 36.50 | 36.10 | | |

TABLE 2-continued

| | B2 | B1 | S1 | E1 |
|---|---|---|---|---|
| Acrylic/maleic copolymer | | | 6.00 | 20.00 |
| Sodium citrate 2aq | 3.00 | 3.33 | 4.00 | 8.50 |
| Sodium silicate (100%) | | | 1.20 | |
| Sodium carbonate light | 24.50 | 24.96 | | 60.00 |
| Sodium carboxymethyl cellulose (68.5%) | 0.90 | 0.81 | 0.80 | |
| Sodium sulphate | | | 25.20 | |
| Moisture and salts | 7.00 | 8.42 | 11.10 | 10.00 |
| Total | 100.00 | 100.00 | 100.00 | 100.00 |
| Bulk density (g/l) | 735–755 | 600–650 | 310–395 | 260 |
| DFR (ml/s) | ca 130 | ca 125 | 60–90 | ca 115 |
| Average particle size | ca 625 | 550–650 | 345–460 | |
| Fines <180 micrometers | 6.3–8.9 | 5–10 | 14–22 | |
| Oversize >1.4 mm | 1.1–3.8 | <2 | 1.5 | |
| Dispensing at 10° C. | 0–2 | 0 | 0 | 0 |

Fully formulated detergent compositions were prepared by mixing the non-tower base powders B1 and B2 with the spray-dried base powder S1 or the spray-dried adjunct E1, and postdosing further ingredients, in the proportions given in Table 3.

TABLE 3 outline formulations

| | C | 5 | D | 6 |
|---|---|---|---|---|
| B2 | 39 | | 52 | |
| B1 | | 45 | | 55 |
| S1 | 22 | 16 | | |
| E1 | | | 10 | 8 |
| Postdosed ingredients | 39 | 39 | 38 | 37 |

Full formulations are given in Table 4 below. The subtotals represent the total of ingredients from the base powder (s) and, if present, the sesquicarbonate adjunct.

Table 5 gives powder properties for the four formulations.

These results show how final products having similar bulk densities and powder properties may be obtained using a higher proportion of non-tower base powder, when the non-tower base powder is a lower-bulk-density granule in accordance with the present invention.

TABLE 4 full formulations

| | C | 5 | D | 6 |
|---|---|---|---|---|
| LAS (as acid) | 4.56 | 1.95 | 6.08 | 6.51 |
| LAS | 2.68 | 5.33 | | |
| Nonionic 7EO | 6.43 | 6.33 | 7.54 | 7.05 |
| Soap/fatty acid | 1.62 | 1.42 | 1.14 | 1.07 |
| Zeolite A (100%) | 7.04 | 5.12 | | |
| Zeolite MAP (100%) | 14.24 | 16.25 | 18.98 | 19.86 |
| AA/MA copolymer | 1.32 | 0.96 | 2.00 | 1.60 |
| Sodium citrate 2aq | 2.05 | 2.14 | 2.41 | 2.51 |
| Sodium silicate (100%) | 0.26 | 0.19 | | |
| Sodium carbonate light | 9.56 | 11.23 | 18.74 | 18.53 |
| SCMC (68.5%) | 0.53 | 0.49 | 0.47 | 0.45 |
| Sodium sulphate | 5.54 | 4.03 | | |
| Moisture and salts | 5.17 | 5.57 | 4.64 | 5.43 |
| Subtotal | 61.00 | 61.00 | 62.00 | 63.00 |
| Sodium percarbonate | 10.50 | 10.50 | 10.50 | 10.50 |
| TAED (83%) | 1.30 | 1.30 | 1.30 | 1.30 |
| Antifoam granule | 1.15 | 1.15 | 1.15 | 1.15 |
| Fluorescer adjunct 15% | 0.80 | 0.80 | 0.80 | 0.80 |

TABLE 4-continued

| full formulations | C | 5 | D | 6 |
|---|---|---|---|---|
| Ca EDTMP 34% | 0.60 | 0.60 | 0.60 | 0.60 |
| Na carbonate (dense) | 11.00 | 11.36 | 11.75 | 11.50 |
| Na bicarbonate | 7.98 | 7.65 | 6.91 | 6.16 |
| Carbonate/silicate granules | 4.50 | 4.50 | 4.50 | 4.50 |
| Protease | 0.18 | 0.18 | 0.18 | 0.18 |
| AA/MA copolymer (gran) | 0.68 | 0.65 | | |
| Perfume | 0.31 | 0.31 | 0.31 | 0.31 |
| Total | 100.00 | 100.00 | | 100.00 |

TABLE 5

| powder properties | C | 5 | D | 6 |
|---|---|---|---|---|
| Bulk density (g/l) | 700–750 | 700–720 | 700–720 | 700–720 |
| DFR (ml/s) | >90 | >90 | >100 | >10 |
| Average particle size | 550–600 | 550–600 | 600–650 | 600–650 |
| Fines (<180 micrometers) (wt %) | 10–15 | 10–15 | 5–10 | 5–10 |
| Oversize (>1.4 mm) (wt %) | ca 1.5 | ca 2 | ca 1.5 | ca 1.5 |
| Dispensing at 10° C. (wt %) | 0–5 | 0–5 | 0 | 0 |

We claim:

1. A particulate zero-phosphate laundry detergent composition having a bulk density within the range of from 550 to 950 g/liter, which comprises at least two different granular components each containing organic surfactant and zeolite builder, said composition comprising:

(i) a first granular component which is a non-spray-died granular component comprising from 10 to 30 wt % of organic surfactant and from 20 to 50 wt % of zeolite, the percentages being based on said first granular component, wherein the zeolite in said first granular component consists of zeolite MAP and said first granular component has a bulk density not exceeding 700 g/l, (ii) a second granular component which is spray-dried and has a bulk density of less than 500 g/l.

2. A detergent composition as claimed in claim 1, wherein the second granular component has a bulk density within the range of from 200 to 450 g/l.

3. A detergent composition as claimed in claim 1, wherein the first and second granular components are present in a weight ratio of at least 1:1.

4. A detergent composition as claimed in claim 1, wherein the first and second granular components are present in a weight ratio within the range of from 1.5:1 to 10:1.

5. A detergent composition as claimed in claim 1, which comprises (i) from 30 to 70 wt % of the first granular component, (ii) from 5 to 40 wt % of the second granular component, (iii) optionally other admixed detergent ingredients to 100 wt %.

6. A detergent composition as claimed in claim 1, which comprises (i) from 35 to 55 wt % of the first granular component, (ii) from 7 to 25 wt % of the second granular component, (iii) optionally other admixed detergent ingredients to 100 wt %.

7. A detergent composition as claimed in claim 1, wherein the second granular component is a spray-dried detergent base powder containing organic surfactant and zeolite A.

8. A detergent composition as claimed in claim 7, wherein the first and second granular components are present in a weight ratio within the range of from 1.5:1 to 5:1.

9. A detergent composition as claimed in claim 7, wherein the weight ratio of zeolite MAP to zeolite A is at least 1:1.

10. A detergent composition as claimed in claim 7, wherein the second granular component has a bulk density within the range of from 275 to 425 g/l.

11. A detergent composition as claimed in claim 7, wherein the second granular component comprises:

from 10 to 30 wt % of organic surfactant, from 20 to 50 wt % of zeolite A, from 10 to 45 wt % of other salts, and optionally minor ingredients to 100 wt %, all percentages being based on the second granular component.

12. A detergent composition as claimed in claim 7, wherein the second granular component comprises:

from 10 to 25 wt % of anionic sulphonate or sulphate surfactant, from 1 to 10 wt % of ethoxylated nonionic surfactant, from 25 to 45 wt % of zeolite A, from 1 to 10 wt % of sodium citrate, from 0 to 10 wt % of acrylic or acrylic/maleic polymer, from 0.5 to 10 wt % of sodium silicate, from 15 to 40 wt % of other salts, and optionally minor ingredients to 100 wt %.

13. A detergent composition as claimed in claim 7, wherein the second granular component further comprises one or more minor ingredients selected from the group consisting of fatty acids, fatty acid soaps, fluorescers and antiredeposition agents.

14. A detergent composition as claimed in claim 1, wherein the second granular component is a spray-dried adjunct containing at least 45 wt % of inorganic material.

15. A detergent composition as claimed in claim 14, wherein the second granular component has a bulk density within the range of from 200 to 300 g/l.

16. A detergent composition as claimed in claim 14, wherein the second granular component is a spray-dried adjunct comprising:

from 45 to 95 wt % of inorganic material comprising a sodium carbonate salt selected from the group consisting of sodium carbonate monohydrate, sodium sesquicarbonate and Burkeite, optionally from 0 to 20 wt % of organic surfactant, optionally from 0 to 25 wt % of a citrate, optionally from 0 to 25 wt % of a polymer, optionally from 0 to 10 wt % of fatty acid and/or soap, and water to 100 wt %, all percentages being based on the second granular component.

17. A detergent composition as claimed in claim 14, wherein the inorganic material in the second granular component comprises crystal-growth modified sodium sesquicarbonate.

18. A detergent composition as claimed in claim 14, wherein the second granular componenet comprises:

from 50 to 90 wt % of inorganic material comprising a sodium carbonate salt selected from the group consisting of sodium carbonate monohydrate, sodium sesquicarbonate and Burkeite, optionally from 0 to 5 wt % of organic surfactant, from 5 to 20 wt % of a citrate, from 5 to 20 wt % of a polymer, from 0.5 to 6 wt % of fatty acid and/or soap, and water to 100 wt %.

19. A detergent composition as claimed in claim 14, wherein the first and second granular components are present in a weight ratio of from 3:1 to 10:1.

* * * * *